United States Patent [19]

Thedens et al.

[11] 4,450,801

[45] May 29, 1984

[54] WATER PRESSURE ACTIVATED OVERRIDE FOR CYLINDER DEACTIVATOR

[75] Inventors: Kevin J. Thedens; Leslie A. Roettgen, both of Columbus, Ind.

[73] Assignee: Cummins Engine Company, Inc., Columbus, Ind.

[21] Appl. No.: 321,648

[22] Filed: Nov. 16, 1981

[51] Int. Cl.[3] ..... F02B 77/08; F02D 17/00

[52] U.S. Cl. ..... 123/198 F; 123/198 DB; 123/196 S; 123/41.15; 123/198 D

[58] Field of Search ..... 123/198 F, 198 DB, 196 S, 123/41.15, 198 D

[56] References Cited

U.S. PATENT DOCUMENTS

| | | | |
|---|---|---|---|
| 3,958,548 | 5/1976 | Koci et al. | 123/41.15 |
| 3,977,384 | 8/1976 | Jahn | 123/196 S |
| 4,150,651 | 4/1979 | Wade et al. | 123/198 F |
| 4,227,505 | 10/1980 | Larson et al. | 123/198 F |
| 4,263,782 | 4/1981 | Matsumoto et al. | 123/198 F |
| 4,274,382 | 6/1981 | Sugasawa et al. | 123/198 F |
| 4,276,863 | 7/1981 | Sugasawa et al. | 123/198 F |

*Primary Examiner*—Ira S. Lazarus

*Attorney, Agent, or Firm*—Gary M. Gron; Robert T. Ruff

[57] ABSTRACT

The disclosure illustrates a means for automatically controlling the operation of a cylinder deactivating system in a multicylinder compression ignition engine which system is intended to increase the load on the cylinders that have not been deactivated. The control means is responsive to coolant pump output pressure which varies directly as engine rpm varies. The cylinder deactivating system functions either by cutting off the flow of fuel to the injector for each deactivated cylinder or cylinders or by actuating an engine brake system. The control means automatically stops the operation of the cylinder deactivating system when engine rpm increases to the point that the coolant pump output pressure exceeds a threshold level. This prevents any possibility of injector scuffing or loss of power at higher rpm.

10 Claims, 2 Drawing Figures

WATER PRESSURE ACTIVATED OVERRIDE FOR CYLINDER DEACTIVATOR

BACKGROUND

For several years many systems have been used to deactivate a portion of the cylinders of a multicylinder compression ignition engine in order to decrease the white smoke emissions of the engine, especially under cold starting conditions. The theory behind these systems is that by deactivating some of the cylinders, the remaining cylinders will have an increased load and will operate at a higher temperature. As a result, white smoke will be cut back due to the improved combustion of the fuel and air mixture. Usually, these deactivating systems are manually controlled.

The problem associated with such a system is that the failure to turn it off when engine rpm exceeds a low level may result in either injector scuffing or a loss of performance. In the case of manual control over the system, this failure may be due to the operator forgetting to turn it off even though there is a warning light to remind him or her. In the case of automatic control of the deactivators, no one has developed a suitable, inexpensive, and reliable method of reactivating the deactivated cylinders. When the cylinder deactivation is accomplished by cutting off the flow of fuel to the injectors of a portion of the cylinders, the injectors may seize or scuff at an engine speed above idle because there is no fuel cooling the injectors. At low engine rpm the heat buildup is not sufficient to cause such a problem. When the cylinder deactivating system is a compression release engine brake system, the failure to reactivate the deactivated cylinders results in a drastic loss of engine performance and a decrease in fuel economy. Thus automatic reactivation is necessary to prevent the problems arising from either type of system.

Other attempts have been made at automatic reactivation, but they have generally been complicated, not applicable to the particular problems mentioned above, or too expensive. U.S. Pat. Nos. 4,080,947 (Iizuka) and 4,204,514 (Ishida) are examples of deactivation systems which reactivate the cylinders also, but the inventions respond to engine load, not engine rpm. An engine could be operating at a high engine rpm, yet be under a light load. U.S. Pat. No. 4,204,514 has a water temperature sensitive override of the deactivating system. U.S. Pat. No. 4,224,920 (Sugasawa et al) has a cylinder deactivator that works in response to engine load also. It has an additional discriminating circuit to prevent the deactivation of the cylinders when there is a false light load signal from the engine, e.g. during shifting. This circuit functions based on the duration of the light load.

U.S. Pat. No. 3,240,197 (Mock) describes an invention to reduce smog. However, the deactivation and subsequent reactivation is dependent upon vacuum. The cylinders are deactivated under high vacuum and reactivated under low vacuum which does not always correspond to the times described above when reactivation is necessary to minimize injector problems or loss of performance in the engine. U.S. Pat. No. 4,150,651 (Wade et al) has a cylinder deactivator that is intended to lessen emissions, especially white smoke, during engine startup and idling. The cylinders are reactivated or deactivated in response to fuel pump output pressure. The deactivating system is effective. However, since fuel pump output pressure is a function of load and engine rpm, the system may not reactivate the cylinders when the engine is at high rpm and low load.

U.S. Pat. No. 3,977,384 (Jahn) is not an automatic reactivator. It is an engine protection device, which senses engine rpm via coolant pressure and relates it to oil pressure. When the engine speed, as indicated by the water pressure, is high and oil pressure is low, then fuel is cut off to the engine thereby stopping the engine and preventing serious internal damage to parts that require lubrication by engine oil.

SUMMARY OF INVENTION

The above problems are solved by using a simple, inexpensive, adjustable pressure responsive control means in the cylinder deactivating system. The system deactivates a portion of the cylinders of a multicylinder engine by cutting off the flow of fuel to the injectors of those cylinders or by actuating an engine brake system. The responsive pressure control means senses the engine coolant pressure which varies in accordance with engine rpm. The pressure responsive control means actuates the deactivating system only when the engine rpm is below a predetermined level such that the coolant pressure is below a preset threshold level. Thus, the control means will not allow the deactivation to continue when there is a possibility of the fuel injectors scuffing or a significant loss of performance.

DESCRIPTION OF PREFERRED EMBODIMENT

Figure 1:
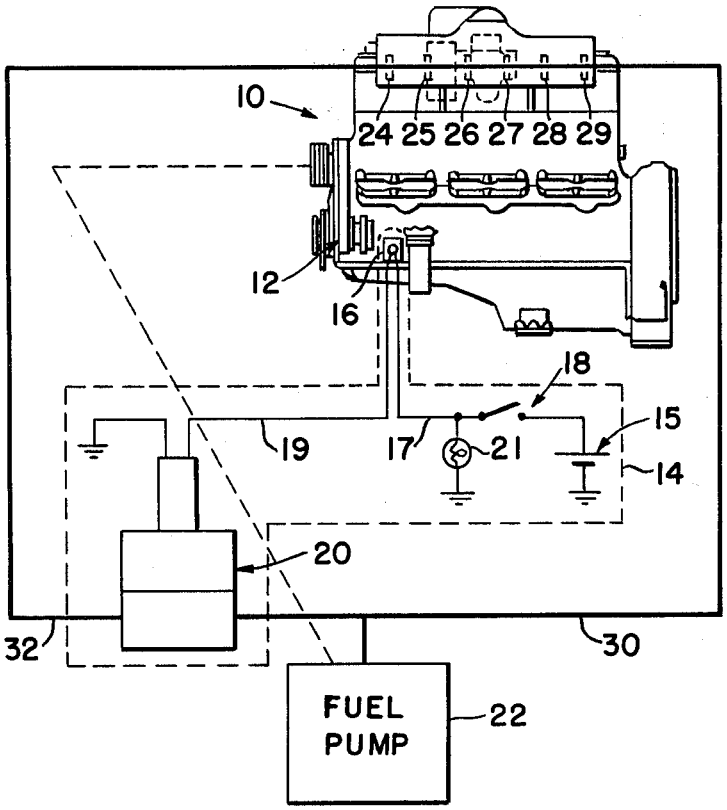
FIG. 1 is a schematic representation of an embodiment of the invention in which the cylinder deactivating system cuts off the flow of fuel to the injectors of a portion of the cylinders.

FIG. 1 shows schematic representation of a preferred embodiment of the present invention, when it is used in conjunction with a cylinder deactivating system, generally indicated at 14, that cuts off the flow of fuel to the injectors of a portion of the cylinders, comprising:

(1) a compression ignition engine 10;
(2) an engine driven coolant pump 12;
(3) an internal passage (not shown) between the coolant pump 12 and an adjustable, pressure responsive, electrical switch 16;
(4) a two-way normally open solenoid valve 20 that is actuated to a closed position by electrical power;
(5) a control switch 18 that is operator controlled for actuating the solenoid 20 and lighting an indicator light 21 by connecting a source of electrical power 15 to solenoid 20 through wires 17, 19;
(6) an engine driven fuel pump 22 that supplies fuel to injectors 26, 27, 28, and 29 through conduit 30 and to injectors 24 and 25 through conduit 32 if solenoid valve 20 permits that flow.

The pressure responsive switch 16 is connected in series with switch 18 and solenoid 20 by wires 17, 19.

In this preferred embodiment, a six-cylinder engine 10 is pictured and the flow of fuel to only two of the injectors 24, 25 is controlled by solenoid valve 20. It should be apparent to those skilled in the art that this invention also works on engines with a different number of cylinders and with the flow of fuel to a different number of injectors under the control of the solenoid valve 20. A commercially available example of the control means is a two-way normally open solenoid valve, model #4176-2-12 manufactured by Gould, Inc., Fluid components Division, Chicago, Ill.

Referring to FIG. 1, in operation, control switch 18 is actuated either by an operator or in response to an engine parameter such as when an engine is cold started or when engine load is so light there is a possibility of white smoke emissions occurring. When engine rpm is low, e.g. at idle, water pump 12 cannot produce enough coolant output pressure to the adjustable, pressure responsive switch 16 to exceed the threshold pressure level as set by adjustment of the pressure switch 16. Therefore, pressure switch 16 does not break the circuit between control switch 18 and solenoid valve 20; and control switch 18 can actuate solenoid valve 20 to stop the flow of fuel from fuel pump 22 through conduit 32 to injectors 24 and 25. At this time, fuel is flowing from fuel pump 22 through conduit 30 to injectors 26, 27, 28 and 29.

When engine rpm is increased, water pump 12 increases its output pressure which is sensed by pressure switch 16.

When that pressure exceeds the threshold level, switch 16 breaks the circuit between control switch 18 and solenoid valve 20. Then solenoid valve 20 no longer interrupts the flow of fuel to injectors 24 and 25 from fuel pump 22 through conduit 32, and the associated cylinders begin to operate.

If pressure switch 16 did not break the circuit when engine rpm was increased, injectors 24 and 25 may begin to overheat because they can not dissipate enough of the increased heat produced due to the increased rpm. This overheating may cause the injectors 24, 25 to scuff and eventually seize. Therefore, it is imperative that a simple, inexpensive, and reliable reactivation method such as this coolant pressure responsive switch be utilized in conjunction with a cylinder deactivating system.

Figure 2:
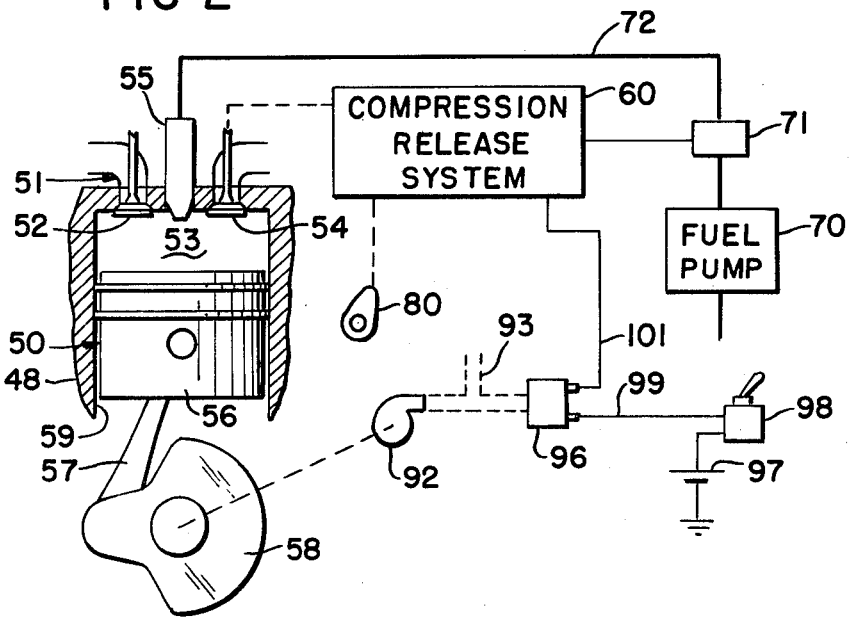
FIG. 2 is a schematic representation of an embodiment of the present invention in which the cylinder deactivating system is a compression release engine brake system.

FIG. 2 shows a schematic representation of the present invention when it is used in conjunction with a cylinder deactivating system that is a compression release engine brake system, comprising:

(1) a compression ignition engine 48 with one cylinder unit 50, shown in detail including: piston 56, connecting rod 57, crankshaft 58, cylinder wall 59, cylinder head 51, intake valve 52, exhaust valve 54 and injector 55.

(2) an engine driven coolant pump 92;

(3) an internal passage 93 between coolant pump 92 and an adjustable, pressure responsive, electrical switch 96;

(4) a control switch 98 that is operator controlled for connecting a source of electrical power 97 to compression release engine brake system 60 through wires 99, 101;

(5) a compression release engine brake system 60 that is electrically actuated (i) through any one of a variety of methods to vary the valve timing so that the intake valve 52 or exhaust valve 54 or all valves 52 and 54 of at least one cylinder unit 50 open when the piston 56 is at or near top dead center and is on the compression stroke; and (ii) at least one solenoid valve 71 that cuts off most or all flow of fuel from fuel pump 70 to the cylinder unit 50 whose valve timing has been varied. Several examples of this type of system may be found in U.S. Pat. No. 3,220,392 (Cummins) and U.S. Pat. No. 3,786,792 (Pelizzoni);

(6) a camshaft 80 for opening and closing the intake valve 52 and exhaust valve 54 through any one of a variety of methods.

In this preferred embodiment a six cylinder engine 48 is pictured and the compression release engine brake system 60 is shown as working on only one cylinder unit 50 and cutting off most or all fuel to that cylinder unit 50. It should be apparent to those skilled in the art that this invention also works on engines with a different number of cylinders and with the compression release engine brake system affecting more than one cylinder unit 50. For simplicity, neither the drawing nor this description goes into the details of the various types of compression release engine brake systems that are commercially available or are subject to a patent. The operation and design of these except for their being solenoid controlled are not relevant to the proper functioning of the invention.

Referring to FIG. 2, in operation, control switch 98 is actuated manually by an operator or in response to an engine parameter such as when an engine is started or when engine load is so light there is a possibility of excess emissions occurring. When engine speed is low, e.g. at idle, water pump 92 cannot produce enough coolant output pressure through passage 94 to adjustable, pressure responsive switch 96 to exceed the pressure level set by adjustment of the switch 96. Therefore, pressure responsive switch 96 does not break the circuit between control switch 98 and compression release engine brake system 60. Control switch 98 actuates: (i) at least one solenoid (not shown) within compression release engine brake system 60 that, through any one of a variety of methods, varies the valve timing so that the exhaust valve 54 or the intake valve 52, or all valves 52, 54 of at least one cylinder unit 50 open when the piston 56 is at or near top dead center and is on the compression stroke, and (ii) at least one other solenoid (not shown) within compression release engine brake system 60 that, through any one of a variety of methods, cuts off most or all of the fuel flow from fuel pump 70 to injector 55. Thus, there is a pressure from the gases being compressed by piston 56 in chamber 53 as the piston 56 approaches top dead center on the compression stroke that reacts against piston 56 through connecting rod 57 to crankshaft 58 that tends to slow the rotation of crankshaft 58. However, when the compression is released through the valves 52, 54 and there is little or no fuel to be ignited, then there is no work available from the expansion of the ignited gases or of the unignited compressed gases when the piston 56 passes top dead center on the compression stroke and begins the power stroke. The frictional drag in that cylinder unit 50 is not overcome by the expansion pressure that would normally be present and the drag tends to slow the rotation of the crankshaft 58 also. The load from these slowing forces must be overcome by the other cylinders (not shown) on which the compression release engine brake system is not working. The increased load causes these other cylinders to operate at a higher temperature resulting in improved combustion and reduced emissions. When engine rpm is increased, water pump 12 increases its output pressure through passage 93 to adjustable pressure responsive switch 96. When that pressure exceeds the threshold level, pressure responsive switch 96 breaks the circuit between control switch 98 and compression release engine brake system 60. Then valve timing returns to normal and fuel flow resumes to the injector 55.

The pressure responsive switch 96 solves two problems in this case. First, if pressure responsive switch 96 does not break the circuit when engine rpm was increased, a large performance loss would occur due to the inactive cylinder 50. Second, injector scuffing may occur as in the case of the first cylinder deactivating system.

Although two preferred embodiments of the present invention have been described, it should be noted by those skilled in the art that the invention can be practiced in other forms without departing from the spirit and scope of it.

Having thus described the invention, what is claimed as novel and desired to be secured by Letters Patent of the United States is:

1. In a multicylinder, compression ignition engine having a pressurized liquid cooling system in which an engine driven coolant pump varies system pressure generally as a direct function of engine rpm, the improvement comprising:

a means for selectively deactivating at least a portion of the cylinders, a solenoid responsive to the presence of an electrical signal for actuating said deactivating system, an operator controlled switch for selectively supplying the electrical signal to said solenoid; and, a control means maintainable in either of two states in response to engine coolant pressure, one of which state terminates the electrical signal to said deactivating means when coolant system pressure and therefore engine rpm is above a predetermined level, thereby overriding the function of the operator controlled switch.

2. Apparatus as in claim 1 in which:

(a) The multicylinder engine has a fuel injection system with an injector for each cylinder;

(b) the cylinder deactivating means comprises a valve for cutting off the flow of fuel to the injectors of the deactivated cylinders, said valve being responsive to said solenoid: and (c) the control means permits application of the electrical signal to the solenoid only when coolant system pressure and therefore engine rpm is below said predetermined level.

3. Apparatus as in claim 1 in which the cylinder deactivating means is an engine brake system actuated by said solenoid in response to said electrical signal, and the control means permits application of the electrical signal to said solenoid only when the coolant system pressure and therefore engine rpm is below said predetermined level.

4. Apparatus as in claim 2 in which the control means actuates only when the coolant pressure drops below a threshold pressure that occurs at a low predetermined engine speed such as idle.

5. Apparatus as in claim 3 in which the control means actuates said solenoid only when the coolant pressure drops below a threshold pressure that occurs at a low predetermined engine speed such as idle.

6. Apparatus as in claim 4 in which the engine has six cylinders and the deactivating device cuts off the flow of fuel to the injectors of two of the cylinders.

7. Apparatus as in claim 6 in which the solenoid actuates a one way, normally open, valve.

8. Apparatus as in claim 7 in which the control means is an adjustable, pressure responsive, electrical switch, exposed to the coolant output pressure, that closes an electrical circuit between the actuating switch and the solenoid, when the coolant output pressure is below the threshold level.

9. Apparatus as in claim 5 in which the engine has six cylinders and the engine brake system deactivates two of the cylinders.

10. Apparatus as in claim 9 in which the control means is an adjustable, pressure responsive, electrical switch, exposed to the coolant output pressure that closes a circuit between the actuating switch and the solenoid only when the coolant output pressure is below the threshold level.

* * * * *